US011840787B2

(12) United States Patent
Feldager Hansen et al.

(10) Patent No.: US 11,840,787 B2
(45) Date of Patent: Dec. 12, 2023

(54) TUFTING TOOL MODULE

(71) Applicant: VANDEWIELE SWEDEN AB, Ulricehamn (SE)

(72) Inventors: Lars Feldager Hansen, Skive (DK); Peter Victorin, Sjomarken (SE); Tomas Hendberg, Sandared (SE)

(73) Assignee: VANDEWIELE SWEDEN AB, Ulricehamn (SE)

( * ) Notice: Subject to any disclaimer, the term of this patent is extended or adjusted under 35 U.S.C. 154(b) by 0 days.

(21) Appl. No.: 17/772,292

(22) PCT Filed: Oct. 21, 2020

(86) PCT No.: PCT/SE2020/051015

§ 371 (c)(1),
(2) Date: Apr. 27, 2022

(87) PCT Pub. No.: WO2021/086250

PCT Pub. Date: May 6, 2021

(65) Prior Publication Data

US 2022/0380954 A1 Dec. 1, 2022

(30) Foreign Application Priority Data

Oct. 29, 2019 (SE) ..... 1951234-2

(51) Int. Cl.
*D05C 15/22* (2006.01)

(52) U.S. Cl.
CPC ..... *D05C 15/22* (2013.01)

(58) Field of Classification Search
CPC ..... D05C 15/00–36
See application file for complete search history.

(56) References Cited

U.S. PATENT DOCUMENTS 3,006,172 A 10/1961 Porter
3,485,195 A * 12/1969 Torrence ..... D05C 15/20 112/226

(Continued)

FOREIGN PATENT DOCUMENTS

CN 2 871 574 2/2007

OTHER PUBLICATIONS

International Search Report for PCT/SE2020/051015, dated Dec. 10, 2020 (3 pages).

(Continued)

*Primary Examiner* — Ismael Izaguirre
(74) *Attorney, Agent, or Firm* — NIXON & VANDERHYE P.C.

(57) ABSTRACT

A tufting tool module (10) for a tufting machine is provided. The tufting tool module comprises a plurality of tufting tools (20). The tufting tools have a head portion and a securing portion. The securing portion of each tufting tool is casted in a base block (12). The securing portions of each tufting tool is provided with at least two cut outs (26, 28) located inside the base block. By providing such cut outs it is possible to reduce the lateral pressure differences between the different tufting tools of the tufting tool module during casting of the base block. This is because the cast material, such as zinc, is allowed to move more freely within the cast during casting of the base block. Furthermore, the cut outs will during the cooling phase of the metal, e.g. zinc, control and stabilize the shrinkage so the tufting tools will not be dislocated. In other words, dislocation of the tufting tools during the casting process can hereby be reduced or eliminated. The result is a tufting tool module with improved tolerances.

14 Claims, 8 Drawing Sheets

(56) References Cited

U.S. PATENT DOCUMENTS

| | | | | |
|---|---|---|---|---|
| 4,241,675 | A | 12/1980 | Bardsley | |
| 4,303,024 | A | 12/1981 | Bardsley | |
| 4,313,388 | A * | 2/1982 | Biggs | D05C 15/22 112/80.53 |
| 4,739,717 | A | 4/1988 | Bardsley | |
| 5,860,373 | A | 1/1999 | Beyer et al. | |
| 7,191,717 | B2 * | 3/2007 | Green | D05C 15/16 112/80.45 |
| 7,520,229 | B2 * | 4/2009 | Hillenbrand | D05C 15/24 112/80.5 |
| 7,562,632 | B2 * | 7/2009 | Hillenbrand | D05C 15/22 112/80.55 |
| 7,717,049 | B2 * | 5/2010 | Hillenbrand | D05C 15/22 112/80.55 |

OTHER PUBLICATIONS

Written Opinion of the International Searching Authority for PCT/SE2020/051015, dated Dec. 10, 2020 (5 pages).

* cited by examiner

TUFTING TOOL MODULE

This application is the U.S. national phase of International Application No. PCT/SE2020/051015 filed Oct. 21, 2020 which designated the U.S. and claims priority to SE 1951234-2 filed Oct. 29, 2019, the entire contents of each of which are hereby incorporated by reference.

TECHNICAL FIELD

The present disclosure relates to tufting, and in particular to a module for tufting tools.

BACKGROUND

In tufting, a textile is produced by a textile process in which a thread is inserted on a primary base. Specialized machinery can be used to produce a tufted textile. Such machinery typically can make use of tufting tools to insert the thread to the primary base and to apply the thread in a described manner. In some applications, the tufting tools are provided in a tufting tool module to facilitate reconfiguration of the machinery for different applications. In a tufting tool module, a plurality of tools are embedded within a common cast body member in a side-by-side configuration. To ensure a good function of the loop forming and a good quality of the tufted fabric, it is essential that the different tufting tools are aligned with each other with very high precision. Typically, a tufting machine can hold 2000 needles, hooks and knifes, and they typically match each other with a precision of tenths of a millimeter, or sometimes even hundreds of a millimeter.

Known tufting tool modules are described in for example U.S. Pat. Nos. 4,303,024 and 5,860,373. For example, in U.S. Pat. No. 4,303,024 a tufting tool module is described having a hole in the securing portion of hooks in order to receive metal for securing the hooks in the base member of the tufting tool module.

There is a constant desire to improve textile machines including tufting machines and parts used within such machinery. Hence, there is a need for an improved tufting tool module that can be used in a tufting machine.

SUMMARY

It is an object of the present invention to improve tufting machines and in particular to provide an improved tufting tool module.

This object and/or others are obtained by the tufting tool module as set out in the appended claims.

As has been realized, during the casting process of a tufting tool module, the plurality of tufting tools cast to the base of the tufting tool module tends to be laterally displaced in relation to each other. The result is that the tufting tool module in some cases does not meet the requirements with regard to tolerances. Subsequent re-alignment of the tufting tools can then become necessary which is undesired and increases production costs and production time.

This problem is solved by a tufting tool module as set out in the appended claims.

In accordance with the invention a tufting tool module for a tufting machine is provided. The tufting tool module comprises a plurality of tufting tools. The tufting tools have a head portion and a securing portion. The securing portion of each tufting tool is casted in a base block. The securing portions of each tufting tool is provided with at least two cut outs located inside the base block. By providing such cut outs it is possible to reduce the lateral pressure differences between the different tufting tools of the tufting tool module during casting of the base block. This is because the cast material, such as zinc, is allowed to move more freely within the cast during casting of the base block. Furthermore, the cut outs will during the cooling phase of the metal, e.g. zinc, control and stabilize the shrinkage so the tufting tools will not be dislocated. In other words, dislocation of the tufting tools during the casting process can hereby be reduced or eliminated. The result is a tufting tool module with improved tolerances.

In accordance with some embodiments, the tufting tools are formed such that an upper side of the head portion is displaced in relation to an upper side of the securing portion.

In accordance with some embodiments, at least one of said at least two cut outs have a cross-section in the range of 1-5 mm, typically, in the range of 1.5-2.5 mm. In particular at least one of the at least two cut outs have a cross-section of 2 mm. Hereby dislocation can be minimized.

In accordance with some embodiments, at least one of said at least two cut outs is formed as a through hole. In one embodiment, two through holes are formed in the securing portion located inside the base block. Some or all of the cut outs can be circular to provide better performance with regard to reducing the dislocation of the tufting tools during the casting process.

The provision of cut outs in tufting tools is beneficial for all types of tufting tools modules including, but not limited to tufting tool modules having a base block made of zinc. The tufting tools can be any tufting tool casted in a base block including but not limited to, hooks, loopers, reeds, knives, and Level Cut Looper (LCL) tools.

BRIEF DESCRIPTION OF THE DRAWINGS

The present invention will now be described in more detail by way of non-limiting examples and with reference to the accompanying drawings, in which.

DETAILED DESCRIPTION

Figure 1:
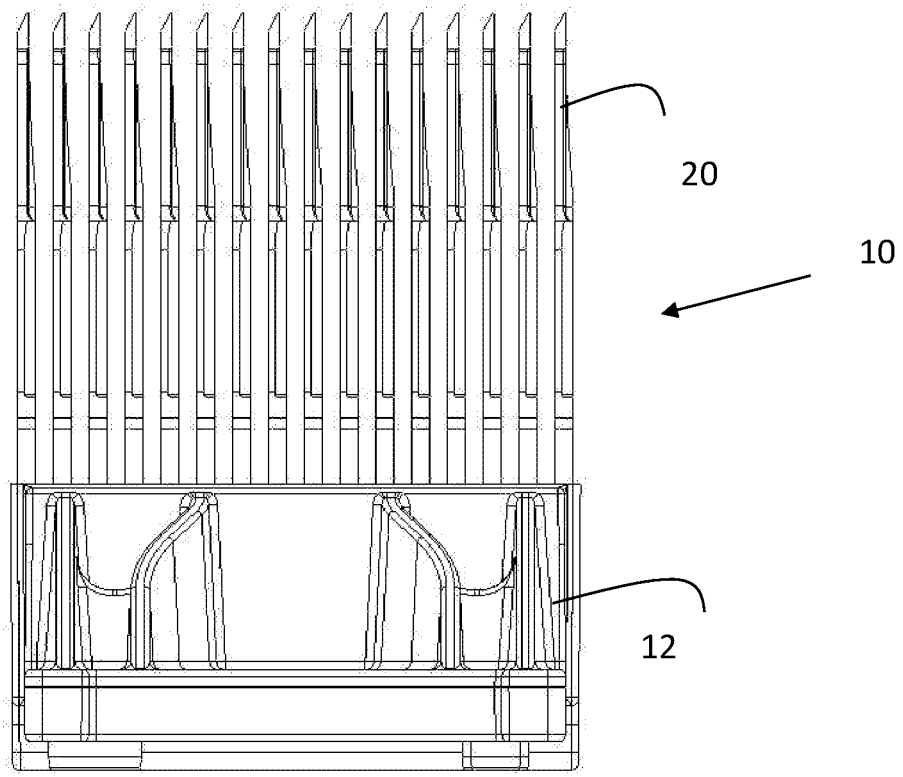
FIGS. 1-3 are views illustrating a tufting tool module in accordance with a first embodiment.

In the following, exemplary tufting tool modules will be described. In the Figures, the same reference numerals designate identical or corresponding elements throughout the several figures. It will be appreciated that these figures are for illustration only and are not in any way restricting the scope of the invention. Also, it is possible to combine features from different described embodiments to meet specific implementation needs.

In FIG. 1, an exemplary tufting tool module 10 in accordance with a first embodiment is depicted in a bottom view. The tufting tool module 10 comprises a plurality of tufting tools 20 cast in a base block 12. The tufting tool 20 is in the embodiment of FIG. 1 hook tools but can in accordance with other embodiments be other types of tufting tools as will be exemplified in conjunction with the description of other embodiments. The base block 12 can typically be a zinc block in which a securing portion of the tufting tools 20 are cast.

When in use in a tufting machine, the base blocks are typically fixed side by side to a bar on the tufting machine. It is essential that the tufting tools in the base block are fixed so that they have exactly the right position in relation to each other and to the other types of tufting tools. For example, the needles must meet with its hook and the knife must meet its hook with a very high precision. In some cases, the base block have locator pins that corresponds to holes in the bar of the tufting machine and in other cases the base blocks are assembled side by side. It is therefore a requirement that the precision between the crucial parts of the tufting tools and the locator pins or base block sides is very high. It has been discovered that the tufting tools tends to be dislocated during the casting process. The dislocation comes from the flow of the molted zinc inserted to the mold and also from uncontrolled shrinkage when the metal, for example zinc, is cooling down.

Figure 2:
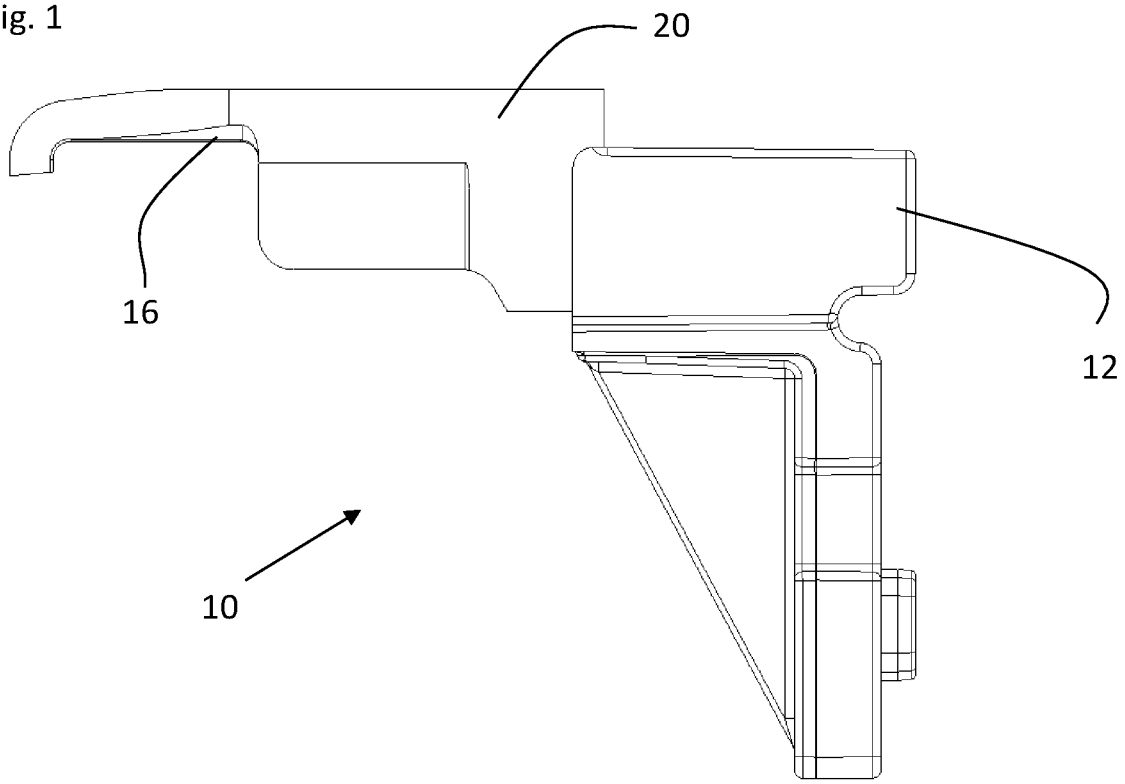

In FIG. 2, the tufting tool module 10 in accordance with the first embodiment is depicted in a side view. The hooks 20 can be provided with an insert. The insert is typically formed by a material being harder than the rest of the tufting tool 20. The insert can typically be provided to protect the hooks 20 from wear from e.g. a knife co-operating with the hooks during operation of a tufting machine in which the tufting tool module 10 can be mounted. A beveling 16 to ensure a clearance for a cutting knife is shown in FIG. 2.

Figure 3:
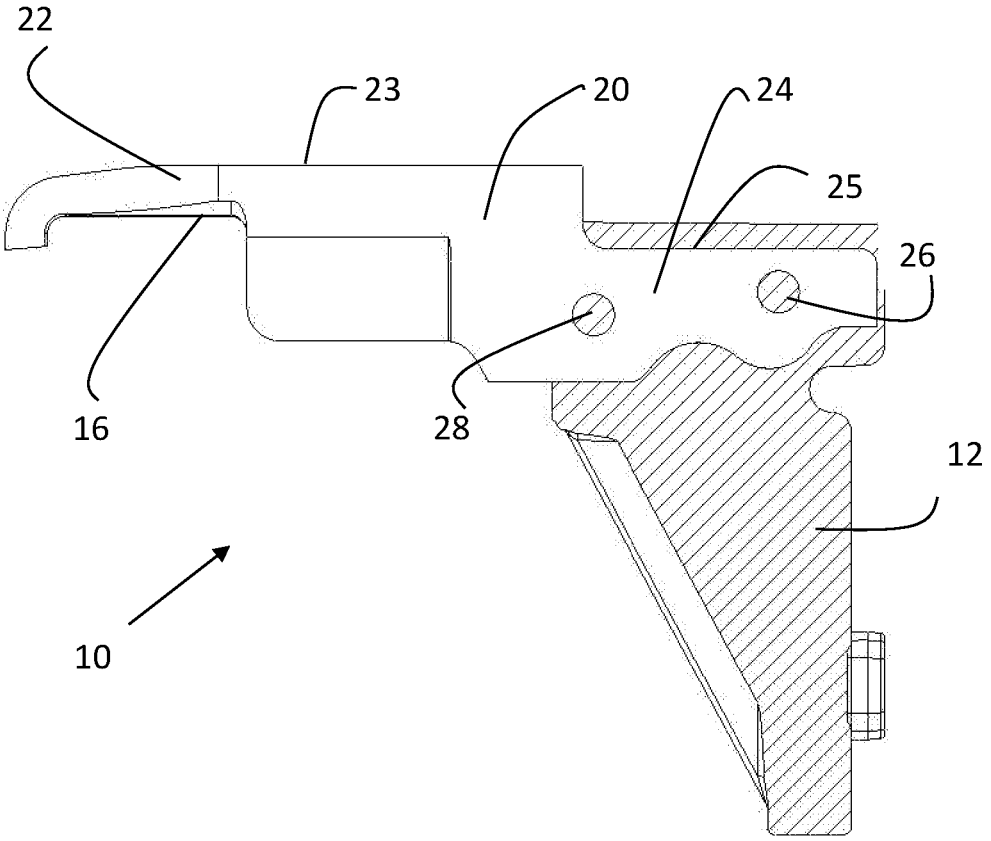

In FIG. 3, the tufting tool module 10 in accordance with the first embodiment is depicted in a cross-sectional side view. The hooks 20 are formed by a securing portion 24 configured to mount the hooks to the base block 12 and a head portion 22 protruding from the securing portion 24. The head portion 22 is provided with an upper edge 23. The securing portion 24 also has an upper edge 25. The upper edge 25 of the securing portion 24 can in accordance with some embodiments be displaced in relation to the upper edge 23 of the head portion 22. In particular the upper edge 25 of the securing portion 24 can be lower in relation to the upper edge 23 of the head portion 22. Further, the securing portion 24 is provided with cut outs 26, 28. The cut outs 26, 28 are in the embodiment of FIG. 3 two, circular, through holes. However, the cut outs can be formed in other configurations as well as will be exemplified later.

When cut outs are provided as through holes as in this embodiment, and in other embodiments as well, it can be advantageous to locate one through hole at a location corresponding to the forward rim of the base block 12, i.e. the rim facing the head portion 22. This would be through hole 28 in the embodiment shown in FIG. 3. Also, it can be advantageous to locate the through holes at a location where the distance is equal to or close to equal to the upper and lower edge, respectively, of the securing portion 24.

The cut outs 26, 28 are provided to reduce or eliminate dislocation of the tufting tools 20 during casting of the base block 12 of the tufting tool module 10. Thus, when the base block 12 is cast in zinc, or some other material, the casting procedure itself can result in that pressure is applied to the securing portion 24 of the tufting tools 20 whereby when the casting procedure is ended the tufting tools 20 can become displaced in relation to the position in which the tufting tools where aligned before the casting. The provision of the cut outs 26, 28 can reduce the lateral pressure differences between the different tufting tools 20 of the tufting tool module 10. This is because the cast material, such as zinc, is allowed to move more freely within the cast during casting of the base block 12. Furthermore, the cut outs will during the cooling phase of the metal, e.g. zinc, control and stabilize the shrinkage so the tufting tools will not be dislocated. In other words, dislocation during the casting process can hereby be reduced or eliminated.

Figure 4:
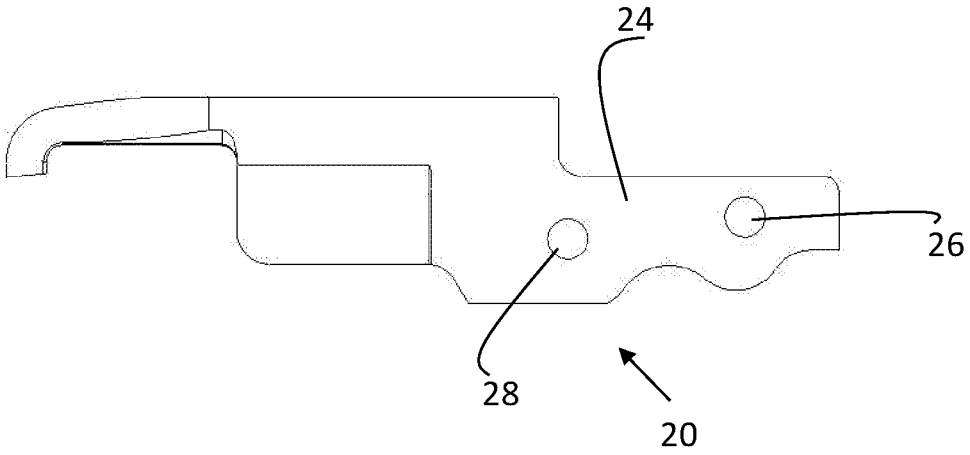
FIG. 4 is a view of a tufting tool for use in the tufting tool module in accordance with the first embodiment.

In FIG. 4, the tufting tool 20, a hook, in accordance with the first embodiment is depicted in a side view. The hook 20 is shown with cut outs 26, 28 in the securing portion 24 as described in conjunction with FIG. 3. The cut outs 26, 28 can advantageously be formed as circular holes located at some distance from each other. The cross section of the cut outs 26, 28 can advantageously be in the range of 1-5 mm. It is preferred to use a cross-section of 1.5 mm-2.5 mm and 2 mm is used in the embodiment of FIG. 4 to maximize the benefit of the cut outs 26, 28. The cut outs can advantageously be provided simultaneously with forming the tufting tool 20. In accordance with some embodiments the cut outs 26, 28 are formed by electrical discharge machining.

Figure 5:
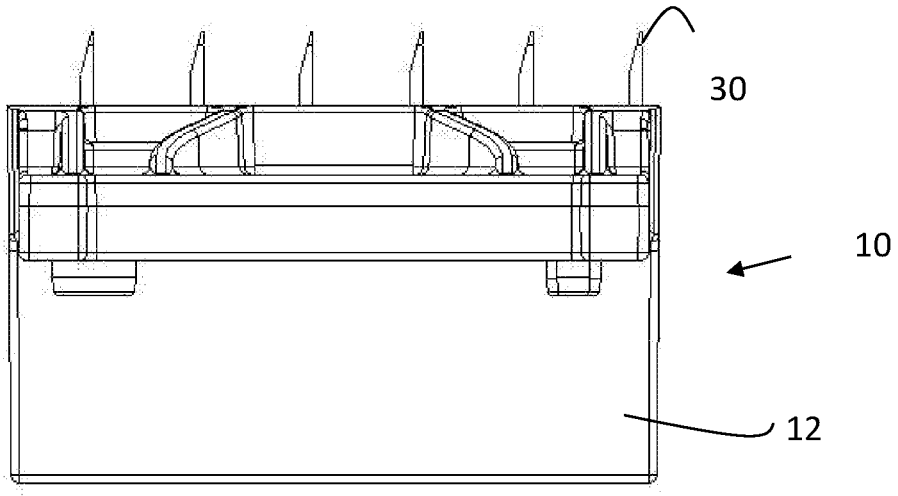
FIGS. 5-7 are views illustrating a tufting tool module in accordance with a second embodiment.

In FIG. 5, an exemplary tufting tool module 10 in accordance with a second embodiment is depicted in a rear view. The tufting tool module 10 comprises a plurality of tufting tools 30 cast in a base block 12. The tufting tool 30 is in the embodiment of FIG. 5 a looper. The base block 12 can typically be a zinc block in which a securing portion of the loopers 30 are cast.

Figure 6:
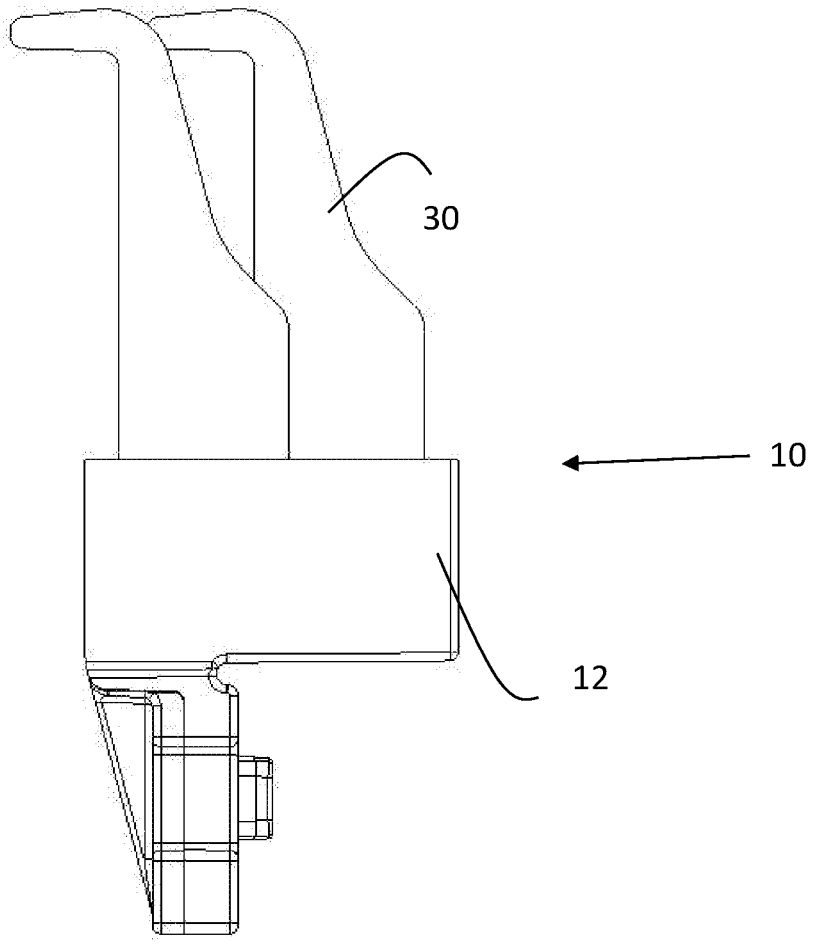
Figure 7:
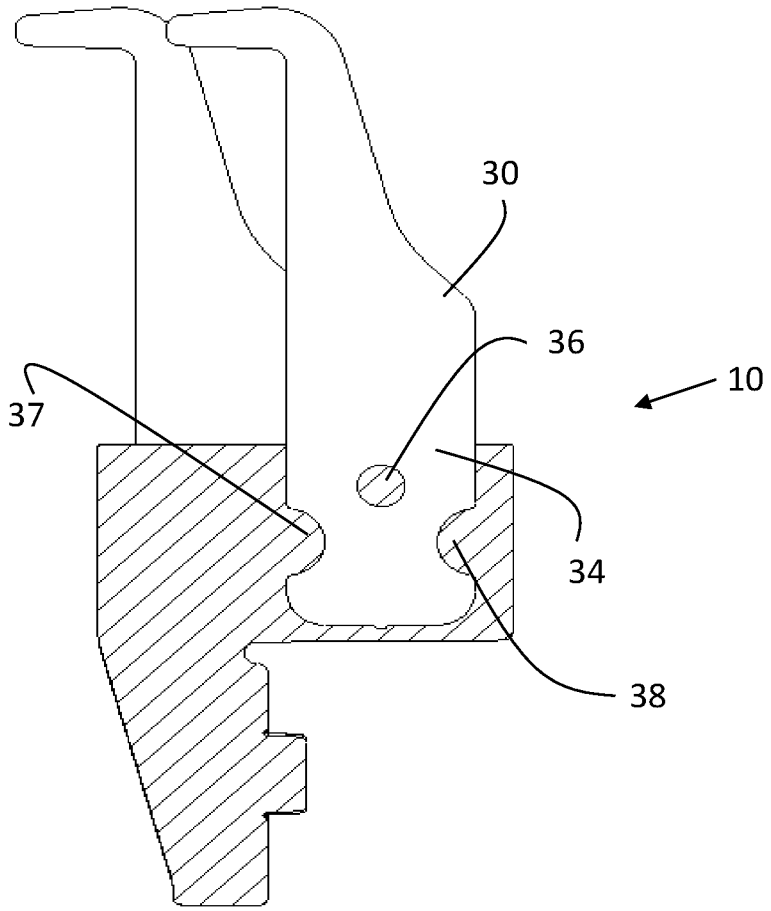

In FIG. 6, the tufting tool module 10 in accordance with the second embodiment is depicted in a side view. In FIG. 7, the tufting tool module 10 in accordance with the second embodiment is depicted in a cross-sectional side view. The loopers 30 comprises a securing portion 34 configured to mount the loopers 30 to the base block 12. The securing portion 34 is provided with cut outs 36, 37, 38. The cut outs 36, 37, 38 comprise in the embodiment of FIG. 7 one, circular, through hole and two semi-circular cut outs at the rim of the securing portion. However, the cut outs 36, 37, and 38 can be formed in other configurations as well. The cut outs 36, 37 and 38 are provided to reduce or eliminate dislocation of the tufting tools 30 during casting of the base block 12 of the tufting tool module 10. Thus, when the base block 12 is cast in zinc, or some other material, the casting procedure itself can result in that pressure is applied to the securing portion 34 of the tufting tools 30 whereby when the casting procedure is ended the tufting tools 30 can become displaced in relation to the position in which the tufting tools where aligned before the casting. Thus, for the second embodiment, the provision of the cut outs 36, 37, and 38 can reduce the lateral pressure differences between the different tufting tools 30 of the tufting tool module 10. This is because the cast material, such as zinc, is allowed to move more freely within the cast during casting of the base block 12. The cut outs 36, 37, and 38 will during the cooling phase of the metal, e.g. zinc, control and stabilize the shrinkage so the tufting tools will not be dislocated. In other words, dislocation during the casting process can hereby be reduced or eliminated.

Figure 8:
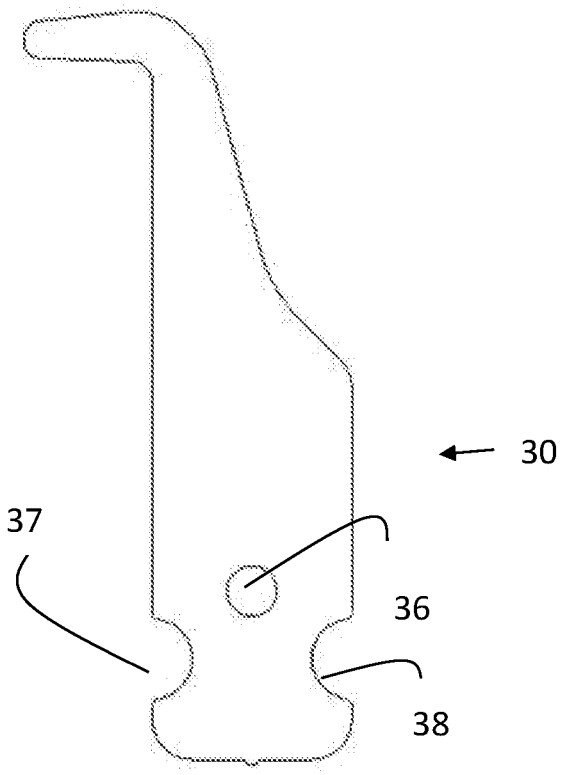
FIG. 8 is a view of a tufting tool for use in the tufting tool module in accordance with the second embodiment.

In FIG. 8, the tufting tool 30, a looper, in accordance with the second embodiment is depicted in a side view. The looper 30 is shown with cut outs 36, 37 and 38 in the securing portion 34 as described in conjunction with FIG. 7. The cut outs 36, 37 and 38 can advantageously be formed as circular holes or semi-circular holes respectively located at some distance from each other. The cross section of the cut outs 36, 37 and 38 can advantageously be in the range of 1-5 mm. It is preferred to use a cross-section of 1.5 mm-2.5 mm and 2 mm is used in the embodiment of FIG. 8 to maximize the benefit of the cut outs 36, 37 and 38. The cut outs 36, 37, and 38 can, as for the first embodiment, advantageously be provided simultaneously with forming the tufting tool 30. In accordance with some embodiments the cut outs 36, 37 and 38 are formed by electrical discharge machining.

Figure 9:
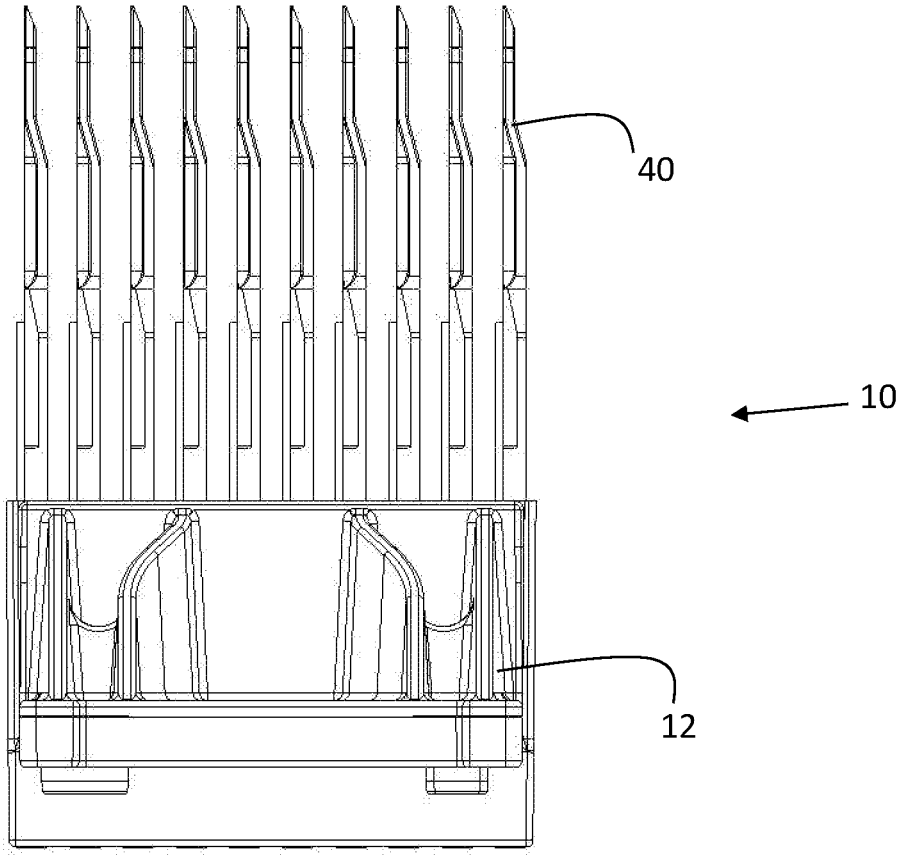
FIGS. 9-11 are views illustrating a tufting tool module in accordance with a first embodiment.

In FIG. 9, an exemplary tufting tool module 10 in accordance with a third embodiment is depicted in a bottom view. The tufting tool module 10 comprises a plurality of tufting tools 40 cast in a base block 12. The tufting tool 40 is in the embodiment of FIG. 9 a Level Cut Looper tool (LCL). The LCL 40 comprises a moving part called slider 41, see FIG. 10, running at the back side of the tufting tool 40 casted in the base block 12. In an LCL tool 40 the moving part 41 decides if a loop shall be cut or not. This moving part 41 is placed in the center of the LCL tool 40, preventing the possibility to make a cut out in the center. The base block 12 can typically be a zinc block in which a securing portion of the LCLs 40 are cast.

Figure 10:
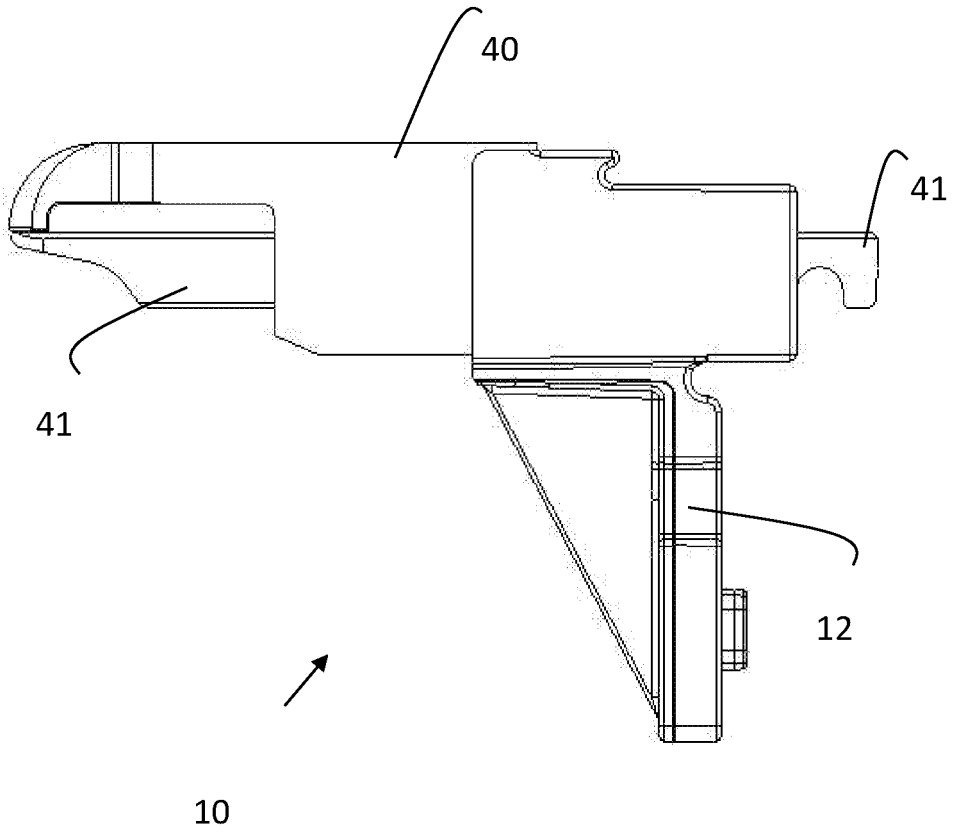
Figure 11:
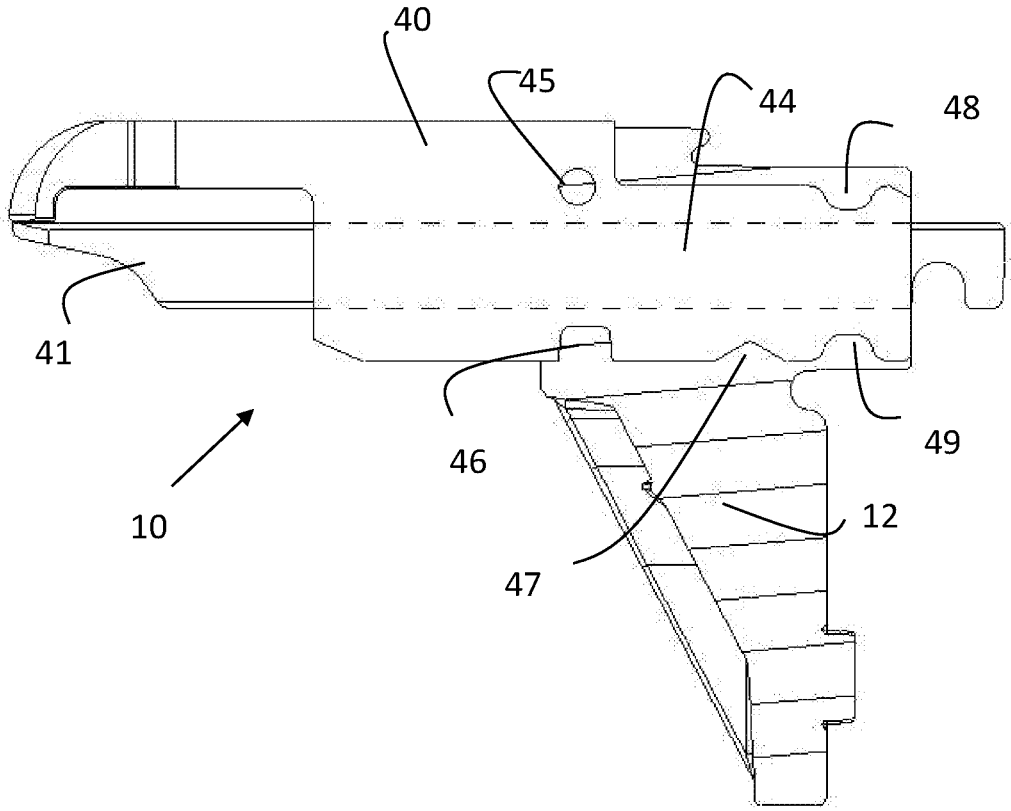

In FIG. 10, the tufting tool module 10 in accordance with the third embodiment is depicted in a side view. In FIG. 11, the tufting tool module 10 in accordance with the third embodiment is depicted in a cross-sectional side view. The LCLs 40 comprises a securing portion 44 configured to mount the LCLs 40 to the base block 12. The securing portion 44 is provided with cut outs 45, 46, 47, 48, and 49. The cut outs 45, 46, 47, 48, and 49 comprise in the embodiment of FIG. 11 one, circular, through hole 45, a forward rectangular cut out 46, two rear rectangular cut outs 48,49 at the rim of the securing portion, and a triangular cut out 47. However, the cut outs 45, 46, 47, 48, and 49 can be formed in other configurations and in other numbers as well. The cut outs 45, 46, 47, 48, and 49 are provided to reduce or eliminate dislocation of the tufting tools 40 during casting of the base block 12 of the tufting tool module 10. Thus, when the base block 12 is cast in zinc, or some other material, the casting procedure itself can result in that pressure is applied to the securing portion 34 of the tufting tools 40 whereby when the casting procedure is ended the tufting tools 40 can become displaced in relation to the position in which the tufting tools where aligned before the casting. Thus, for the third embodiment, the provision of the cut outs 45, 46, 47, 48, and 49 can reduce the lateral pressure differences between the different tufting tools 40 of the tufting tool module 10. This is because the cast material, such as zinc, is allowed to move more freely within the cast during casting of the base block 12. The cut outs 45, 46, 47, 48, and 49 will during the cooling phase of the metal, e.g. zinc, control and stabilize the shrinkage so the tufting tools will not be dislocated. In other words, dislocation during the casting process can hereby be reduced or eliminated.

Figure 12:
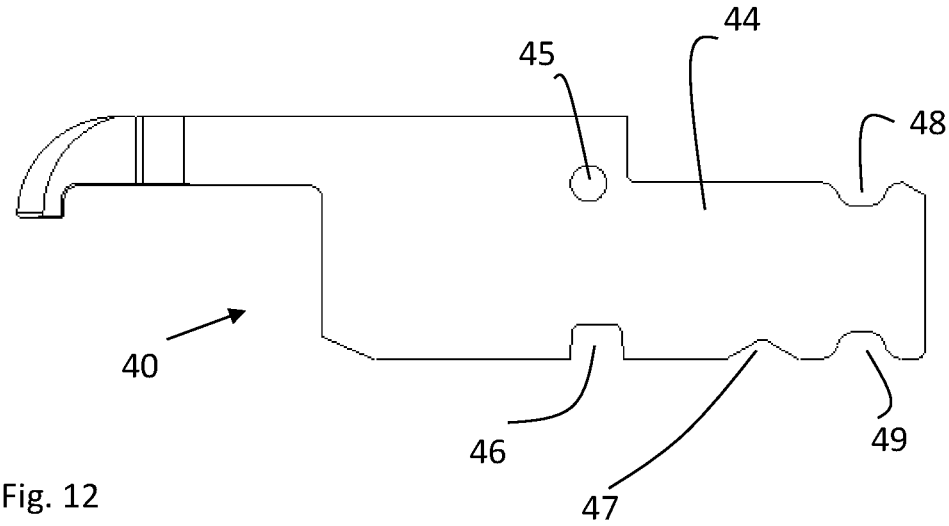
FIG. 12 is a view of a tufting tool for use in the tufting tool module in accordance with the first embodiment.

In FIG. 12, the tufting tool 40, an LCL, in accordance with the third embodiment is depicted in a side view. The LCL 40 is shown with cut outs 45, 46, 47, 48, and 49 in the securing portion 44 as described in conjunction with FIG. 11. The cross section of the cut outs 45, 46, 47, 48 and 49 can advantageously be in the range of 1-5 mm. It is preferred to use a cross-section of 1.5 mm-2.5 mm and 2 mm is used in the embodiment of FIG. 12 to maximize the benefit of the cut outs 45, 46, 47, 48, and 49. The cut outs 45, 46, 47, 48, and 49 can, as for the first and second embodiment, advantageously be provided simultaneously with forming the tufting tool 40. In accordance with some embodiments the cut outs 45, 46, 47, 48, and 49 are formed by electrical discharge machining.

The provision of cut outs in tufting tools is beneficial for all types of tufting tools modules including, but not limited to tufting tool modules having a base block made of zinc. The tufting tools can be any tufting tool casted in a base block including, but not limited to, hooks, loopers, reeds, knives, and Level Cut Looper (LCL) tools.

The invention claimed is:

1. A tufting tool module for a tufting machine, the tufting tool module comprising:

a plurality of tufting tools, the tufting tools comprising a head portion and a securing portion, wherein the securing portion of each tufting tool is casted in a base block, wherein the securing portions of each tufting tool cast in the base block is provided with at least two cut outs located inside the base block, with at least one of the at least two cut outs being formed as a through hole, that reduce dislocation of the tufting tools cast in the base block by reducing lateral pressure differences between the tufting tools.

2. The tufting tool module according to claim 1, wherein the tufting tools are formed such that an upper side of the head portion is displaced in relation to an upper side of the securing portion.

3. The tufting tool module according to claim 1, wherein at least one of said at least two cut outs have a cross-section in the range of 1-5 mm.

4. The tufting tool module according to claim 1, wherein at least one of said at least two cut outs have a cross-section in the range of 1.5-2.5 mm.

5. The tufting tool module according to claim 1, wherein at least one of said at least two cut outs have a cross-section of 2 mm.

6. The tufting tool module according to claim 1, wherein two through holes are formed in the securing portion located inside the base block.

7. The module according to claim 1, wherein at least one of said at least two cut outs is circular.

8. The module according to claim 1, when at least one through hole is provided, wherein the through hole is located at the forward rim of the base block facing the head portion of the tufting tool.

9. The module according to claim 1, wherein said base block is a casted zinc block.

10. The module according to claim 1, wherein said tufting tools are hooks.

11. The module according to claim 1, wherein said tufting tools are loopers.

12. The module according to claim 1, wherein said tufting tools are reeds.

13. The module according to claim 1, wherein said tufting tools are knives.

14. The module according to claim 1, wherein said tufting tools are Level Cut Looper tools.

* * * * *